US006343129B1

(12) United States Patent
Pelrine et al.

(10) Patent No.: US 6,343,129 B1
(45) Date of Patent: Jan. 29, 2002

(54) ELASTOMERIC DIELECTRIC POLYMER FILM SONIC ACTUATOR

(75) Inventors: Ronald E. Pelrine, Boulder, CO (US); Roy D. Kornbluh, Palo Alto; Joseph S. Eckerle, Redwood City, both of CA (US)

(73) Assignee: SRI International, Menlo Park, CA (US)

( * ) Notice: Subject to any disclaimer, the term of this patent is extended or adjusted under 35 U.S.C. 154(b) by 0 days.

(21) Appl. No.: 09/356,801

(22) Filed: Jul. 19, 1999

Related U.S. Application Data

(63) Continuation of application No. PCT/US98/02311, filed on Feb. 2, 1998.
(60) Provisional application No. 60/037,400, filed on Feb. 7, 1997.

(51) Int. Cl.[7] ..... H04R 25/00
(52) U.S. Cl. ..... 381/191; 381/116; 381/174
(58) Field of Search ..... 381/174, 191, 381/113, 116, 190; 307/400; 367/170, 181

(56) References Cited

U.S. PATENT DOCUMENTS 3,403,234 A 9/1968 Barnes et al.
4,400,634 A 8/1983 Micheron
4,843,275 A 6/1989 Radice et al.
4,885,783 A 12/1989 Whitehead et al.
4,969,197 A 11/1990 Takaya
5,206,557 A * 4/1993 Bobbio ..... 381/191
5,229,979 A 7/1993 Scheinbeim et al.

FOREIGN PATENT DOCUMENTS

WO WO95 08905 A 3/1995

* cited by examiner

*Primary Examiner*—Huyen Le
(74) *Attorney, Agent, or Firm*—Brian R. Coleman, MSEE; Tamiz Khan; Oppenheimer Wolff & Donnelly LLP

(57) ABSTRACT

A sonic actuator including a multi-layer membrane having an elastomeric dielectric polymer layer with a first surface and a second surface, a first compliant electrode layer contacting the first surface of the polymer layer, and a second compliant electrode layer contacting the second surface of the polymer layer. The actuator further includes a support structure in contact with the sonic actuator film. Preferably, the dielectric polymer is selected from the group consisting essentially of silicone, polyurethane fluorosilicone, fluoroelastomer, natural rubber, polybutadiene, nitrile rubber, isoprene, and ethylene propylene diene. Also preferably, the compliant electrode layer is made from the group consisting essentially of graphite, carbon, and conductive polymers. The support structure can take the form of grid having a number of circular apertures. When a voltage is applied to the electrodes, portions of the film held at the aperture of the support structure can bulge due to the electrostriction phenomenon. The resultant "bubbles" can be driven to generate sonic vibrations, or can be used to create a variable surface for airflow control.

2 Claims, 7 Drawing Sheets

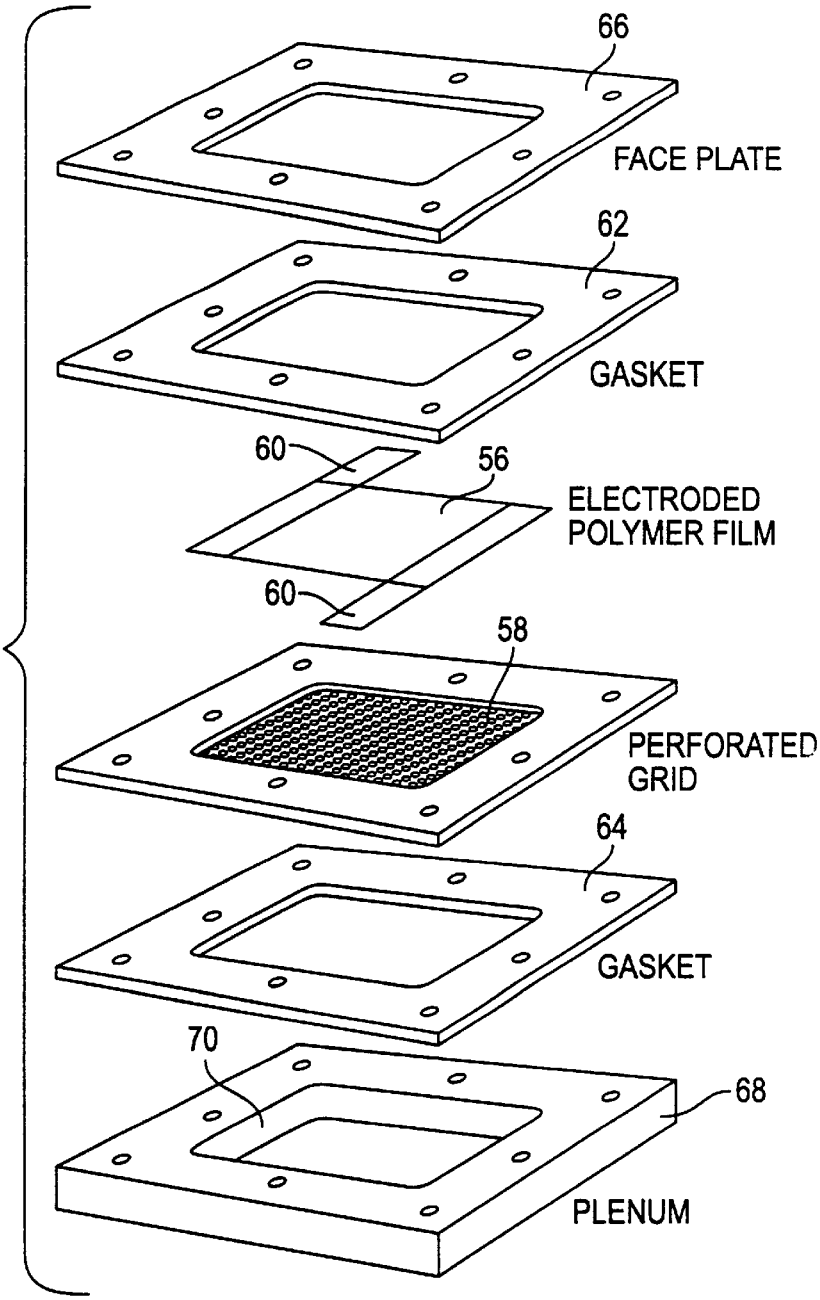
FIG. 5A
FIG. 5B
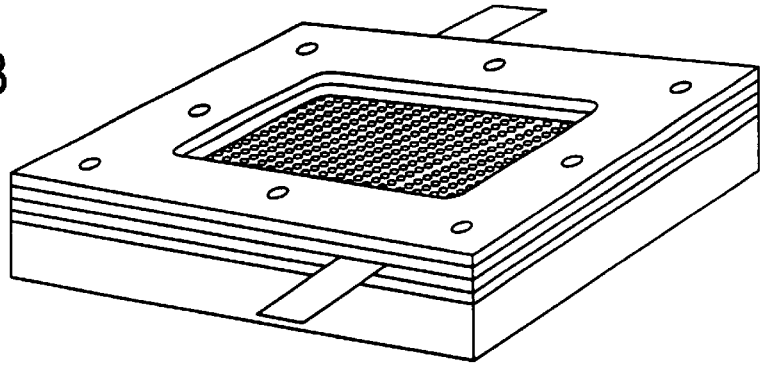

FIG. 6A
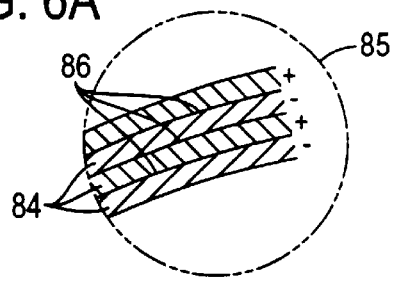
FIG. 6
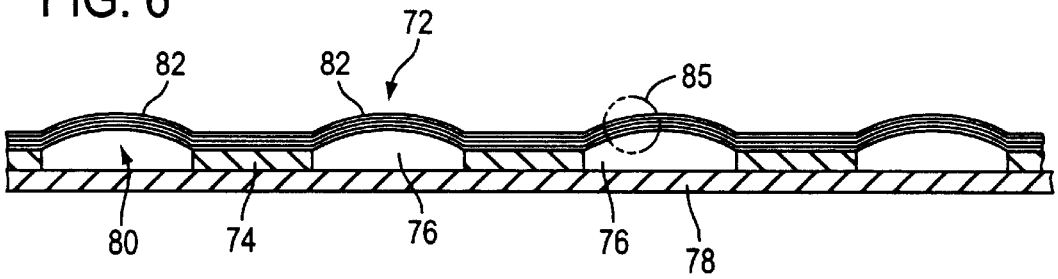
FIG. 7A
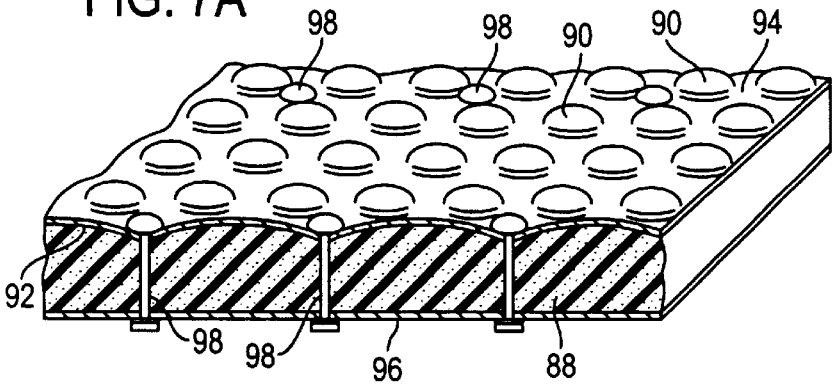
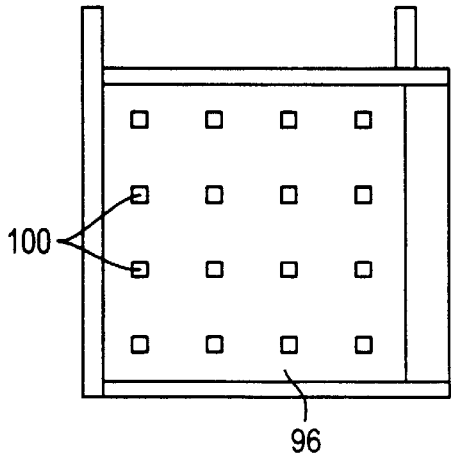
FIG. 7B

ELASTOMERIC DIELECTRIC POLYMER FILM SONIC ACTUATOR

CROSS REFERENCE TO RELATED APPLICATIONS

This application is a continuation of International Application No. PCT/US98/02311 filed on Feb. 2, 1998 which application is entitled to the priority benefit of co-pending U.S. provisional patent application No. 60/037,400, filed Feb. 7, 1997, which is incorporated herein by reference.

U.S. GOVERNMENT RIGHTS

This invention was made in part with government support under contract number N66001-97-C-8611 awarded by the U.S. Navy NCCOSC/RDTE. The government has certain rights in the invention.

BACKGROUND OF THE INVENTION

1. Technical Field

This invention relates generally to acoustic actuators and, more particularly, to flat panel loudspeaker systems.

2. Description of the Related Art

Most acoustic actuators ("loudspeakers" or simply "speakers") are relatively heavy. Further, the they act as point sources for producing sound. Many applications, such as virtual reality, entertainment, and active noise and vibration control, would benefit from loudspeakers that are extremely lightweight, compact and low-profile (i.e. flat), yet capable of high acoustic power emission with a high degree of spatial resolution.

Most existing loudspeakers use cones that are driven by electromagnetic actuators. Such devices have heavy permanent magnets and copper coils. To achieve high spatial resolution would require many such actuators. The weight of many such actuators would be quite high, limiting their use in automotive or aerospace applications. Further these loudspeakers are not low-profile. Low-profile actuators that are based on diaphragms driven by piezoelectric ceramics or polymers exist but do not have high acoustic power output capabilities because the motion of the diaphragm is small for piezoelectric devices. The control of airflow over a surface is another area that requires lightweight, low-profile and large displacement actuators with good spatial resolution.

Existing electrostatic loudspeakers are lightweight and low-profile. However, they have several disadvantages for many applications. Electrostatic speakers use air as the dielectric medium, with a single large continuous flat surface which radiates the sound as it is electrostatically attracted to one or two plates at different voltages. These speakers tend to be costly since it is necessary to carefully construct the speaker so that the large-area moving plate does not contact the stationary plate(s), and yet with a small enough plate spacing to permit using a reasonably-low driving voltage. Electrostatic speakers typically operate with a bias voltage of several thousand volts. Limitations on the driving voltage also limit the acoustic power output.

Acoustic actuators based on the electrostriction of polymers also exist. This type of actuator produces motion from the electrostriction of various polymer films, that is they produce sound primarily by the change in thickness of a polymer film (or stack of films) due to the electrostrictive effect. The displacement of the surface of this device is small compared to its thickness and so the acoustic power output is low.

SUMMARY OF THE INVENTION

This invention relates to an acoustic actuator or loudspeaker system. More specifically, the invention is a device that is capable of producing sound, vibrations, and changes in the shape and roughness of a surface in a fluid medium. Most commonly, it is anticipated that the device will be used as a loudspeaker in air. The invention is also well suited for use as an acoustic actuator for active noise and vibration control systems. The invention may also be used in non-acoustic applications, such as the control of airflow and turbulence on the surface of aircraft, ships, or other objects.

In one embodiment of the present invention, a loudspeaker ("speaker") is provided that is extremely lightweight, compact and low-profile (flat), yet capable of high acoustic power emission. The speaker is easy to manufacture and uses low cost materials. The speaker is flexible and, since it is essentially flat, it can be attached conformably to flat or curved surfaces as if it were an external skin or cover. It is also possible to make the loudspeaker largely transparent, allowing it, for example, to be placed over windows.

The above features imply that the speaker is well suited for applications such as noise cancellation and vibration control where a large radiating area and lightweight are important. Thus, the invention is an improvement over "traditional" speakers that employ electromagnetic or piezoelectric actuators. Those devices require roughly eight and five times, respectively, the actuator mass in order to produce the same power at a given frequency as an acoustic actuator of the present invention. Additionally, since the present invention is formed out of many small elements, individual elements, or groups of elements, can be driven individually for improved spatial resolution. The integration of sensory capabilities (such as a small microfabricated pressure sensor or accelerometer; or using capacitive measurement of the polymer itself) with each actuator element forms the basis of a "smart skin" that can automatically cancel noise or vibration.

Since the elements of the speaker are capable of large deflections, the device has non-acoustic applications as well. For example, an array of small elements may be used to influence the flow of air or other fluids over a surface.

The invention is fundamentally an electrostatic speaker; however, it has important differences from existing electrostatic devices that allow for greater power output, lower operating voltages and a simpler and more versatile design. Traditional electrostatic speakers use air as the dielectric medium, with a single "large" continuous flat surface which radiates the sound as it is electrostatically attracted to one or two plates or grids at different electrical potentials, while this invention uses an elastomeric dielectric. Furthermore, the present invention is composed of one or more discrete elements or "bubbles" that radiate the sound. These differences give the invention distinct advantages over traditional electrostatic speakers in that they permit greater acoustic energy output, lower driving voltages, greater shape versatility, and greater ease of manufacture.

The presence of the polymer dielectric between the electrodes eliminates the need to precisely control the electrode spacing. Dielectric films as thin as 1 micrometer have been demonstrated to operate at approximately 100 V. Electrostatic speakers typically operate with a bias voltage of several thousand volts. The division of the radiating surface into discrete elements eliminates the need to maintain flatness of the radiating surface, allowing the invention to conform to different surface shapes.

The polymer dielectric in the invention allows greater power output (per speaker surface area and weight) at a given voltage, since the electrostatic energy is multiplied by the dielectric constant of the polymer (typically between 2 and 10). In practice, the polymer dielectric will have a greater breakdown voltage than air, due partly to the fact that the polymer prevents the accumulation of particulates on the electrodes. Thus, the electric field generated by the applied voltage can be greater than air-gap devices, further increasing the power output capabilities of the invention (power output is proportional to the square of the electric field).

The invention may also be considered to operate based on the electrostriction of a polymer film. However, it differs from other electrostrictive devices that produce sound primarily by the changing the thickness of a polymer film (or stack of films) due to the electrostrictive effect. In contrast, our invention produces sound by using in-plane strains to induce out-of-plane deflection the film. The apparent stiffness and mass of a polymer film operating in this out-of-plane configuration can be orders of magnitude less than that for compression of the solid polymer as in other electrostrictive devices. The air driven by the film has low mass and stiffness. Thus, the invention is better coupled acoustically to the air resulting in greater acoustic output (per surface area and per weight) for a given electrical input.

The invention depends on a form of electrostriction of a polymer dielectric. However, the mechanism of actuation in the invention is believed to be different from the electrostrictive devices that rely on the change in thickness of the polymer to produce motion in that here the strain results principally from the external forces caused by the electrostatic attraction of the electrodes rather than just from internal intermolecular forces. This distinction gives the invention the advantage that the dielectric materials can be selected based on properties such as high dielectric strength, high volume resistivity, low modulus of elasticity, low hysteresis, and wide temperature operating range (which give advantages of high energy density, high electrical to mechanical energy conversion efficiency, large strains, high mechanical efficiency and good environmental resistance, respectively) rather than just the magnitude of the electrostrictive response for a given field. Dielectric materials with the aforementioned properties (e.g. silicone rubbers) have produced strains over 25%. The literature describing electrostrictive polymer actuators using rigid electrodes does not show any material with an electrostrictive response of this magnitude. Further, electrostrictive materials do not necessarily have a large response in the in-plane directions and, therefore, cannot effectively make use of the out-of-plane deflection mode of operation. Other devices known in the art also do not teach that compliant electrodes are important for operation of the devices. Compliant electrodes are important to the present invention, as they allow for the development of large strains.

The use of polymers with low moduli of elasticity also allows for high acoustic output per surface area and per weight at lower driving voltages than possible with other devices since the resulting motion at a given voltage is greater with the more compliant materials.

The individual elements that comprise the speaker in the invention can be extremely small or large. If small, the elements can be made with microfabrication techniques. Other speakers that function based upon the bending of a small microfabricated diaphragm exist. Such devices employ a silicon micromachined diaphragm. In such devices, the diaphragm may be driven with piezoelectrics or electrostatically. The cost of silicon and of piezoelectric materials greatly exceeds that of the polymers used in the invention and so the total surface area of these devices is limited. Additionally, the maximum energy and power output of the polymer speaker is greater than that of piezoelectric or electrostatic devices on a per weight or per surface area basis up to frequencies of several thousand Hertz. This frequency range is very important in sound production and in noise and vibration cancellation.

Loudspeakers made in conformance with the present invention can be attached conformably to flat or curved surfaces as if they were an external skin or cover. This configuration allows the loudspeaker to cover a larger area with improved spatial resolution of the sound. Other audio applications, such as consumer household or automotive audio speakers and loudspeakers for multimedia and virtual reality presentations can also benefit from improved spatial control of sound and low-profile speakers that could unobtrusively be located on walls, ceilings or other surfaces. Many consumer applications also require that the actuators be easy to manufacture and use low cost materials.

These and other advantages of the present invention will become apparent to those skilled in the art upon a reading of the following descriptions and a study of the drawings.

BRIEF DESCRIPTION OF THE DRAWINGS

FIG. 5*a* is an exploded view of one embodiment of a single "tile" of the present invention.

FIG. 5*b* is the tile of FIG. 5*a* in assembled form.

FIG. 6–6A is a cross-sectional view of an alternate embodiment of the actuator that is well-suited for manufacture by microfabrication techniques.

FIGS. 7*a* and 7*b* illustrate the use of a soft foam biasing member for an alternate embodiment of an acoustic actuator of the present invention.

DETAILED DESCRIPTION OF THE PREFERRED EMBODIMENTS

The invention is a loudspeaker or acoustic actuator that uses the electrostriction of elastomeric polymers in a novel configuration to produce extremely high acoustic output power in a lightweight, low-profile and simple-to-fabricate structure.

Figure 1A:
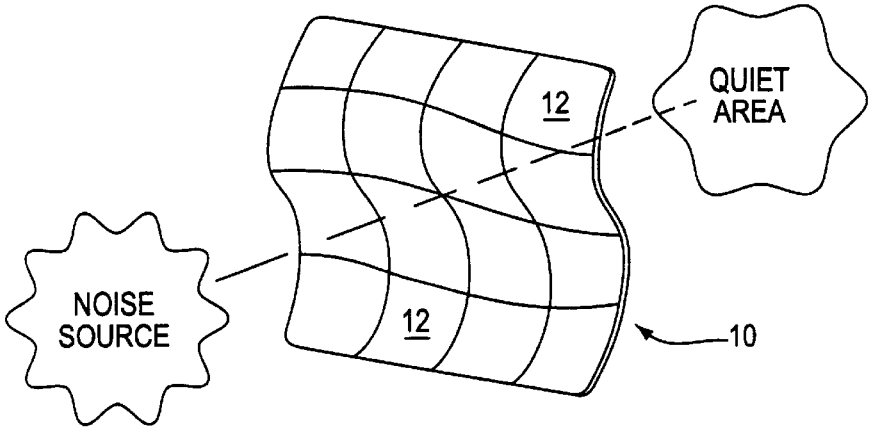
FIGS. 1*a,* 1*b,* and 1*c* show several applications of the invention in active noise cancellation and consumer audio applications.

FIG. 1*a* illustrates a first application for the present invention. An acoustic actuator sheet 10 of electrostrictive polymer acoustic actuators is formed as a number of "tiles" or elements 12, each of which is provided with a microphone (not seen) facing a noise source. This produces a "quiet area" on the other side of the acoustic actuator sheet. The electronic circuitry for driving actuators in response to microphone inputs for noise cancellation purposes are well known to those skilled in the art. The acoustic actuator sheet can be supported by, for example, a frame, or it may be positioned within walls of a structure, such as within the walls of a building or airplane.

Figure 1B:
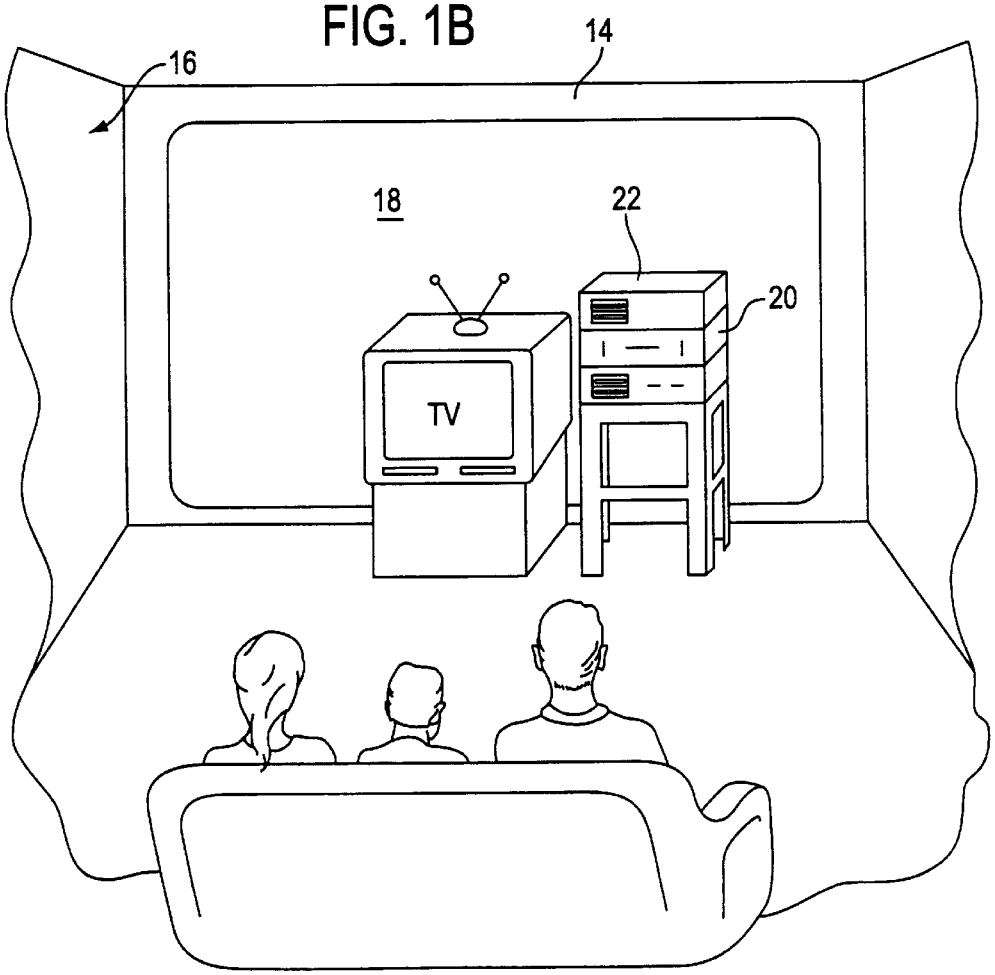

In FIG. 1*b,* a wall 14 of a room 16 is covered with an acoustic actuator sheet 18 ("acoustic wallpaper") to provide a rich, spatial acoustic environment. A spatial equalizer can be used to determine the signal strength to each actuator after amplification by a driver 22. This arrangement allows for a much more even acoustic environment in the room, as compared to prior art "point source" speakers.

Figure 1C:
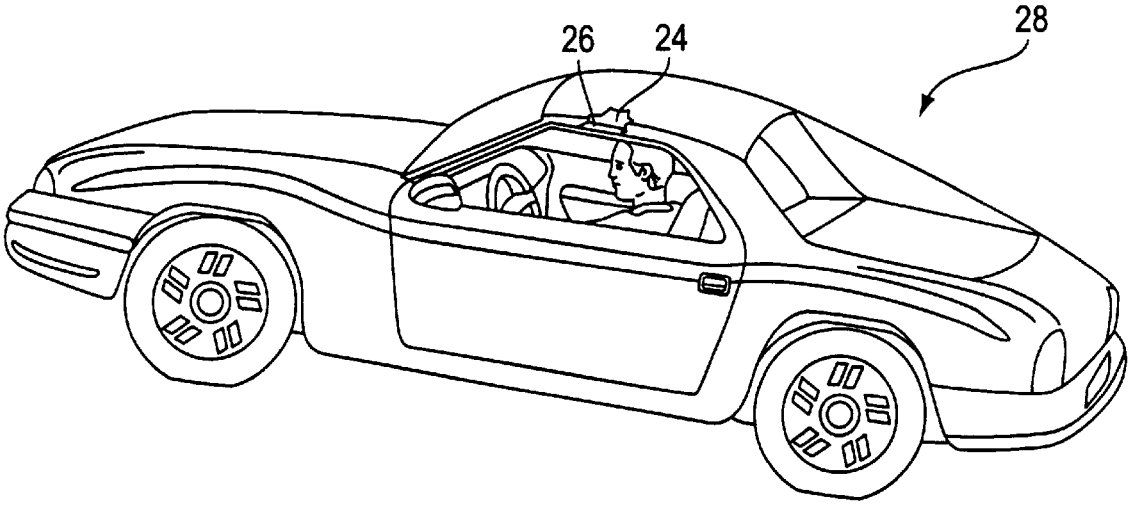

In FIG. 1*c,* an automotive application for the acoustic actuator sheet is illustrated. More particularly, an acoustic actuator sheet 24 is provided in the headliner 26 of the automobile 28. This can be used for noise cancellation, or for distributing sound from, for example, a car audio system, or both. Again, methods and apparatus to provide the control signals for the actuators are well known to those skilled in the art of noise cancellation. The sound from a sound system can be distributed evenly throughout the automobile, or different areas in the automobile can be provided with different sound (e.g. different channels, tracks, or stations).

Figure 2:
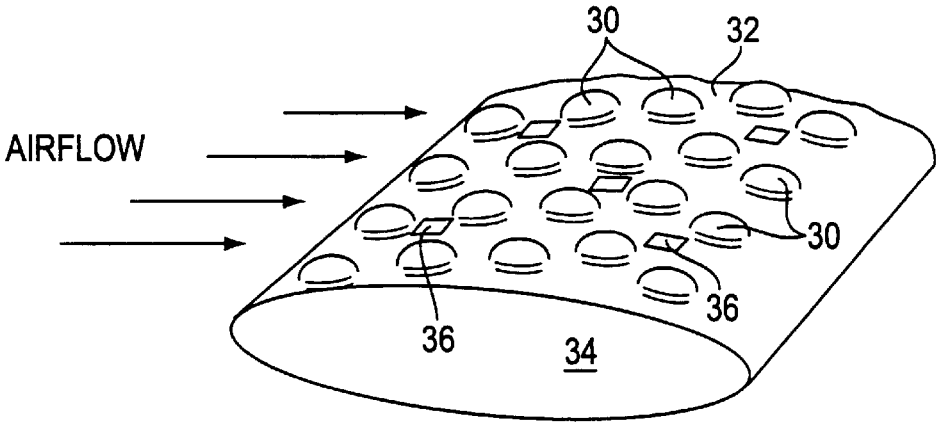
FIG. 2 shows how the invention is used to control the flow of air or other fluids over a surface.

FIG. 2 illustrates the use of the present invention for airflow control. More particularly, the height of each element or "bubble" 30 is regulated based upon a desired surface drag, which can be mathematically modeled. The desired surface drag algorithms can be implemented by microcontroller or microcomputer systems, which control the actuator driver systems. The bubbles can therefore be used to change the surface 32 "roughness" or texture of a structure 34. Pressure sensors 36 can be provided on the surface of the structure to provide inputs to the microcontroller.

The term electrostriction typically refers to strains produced by the interaction of polar molecules in a dielectric where the magnitude of the strain is proportional to the square of the applied electric field. The invention described here is based upon similar polymer response, however, the mechanism of actuation in the invention is different from such devices in that the strain results principally from the external forces caused by the electrostatic attraction of the electrodes rather than from internal intermolecular forces. Nonetheless, the term electrostriction is used herein to describe this response.

Figure 3A:
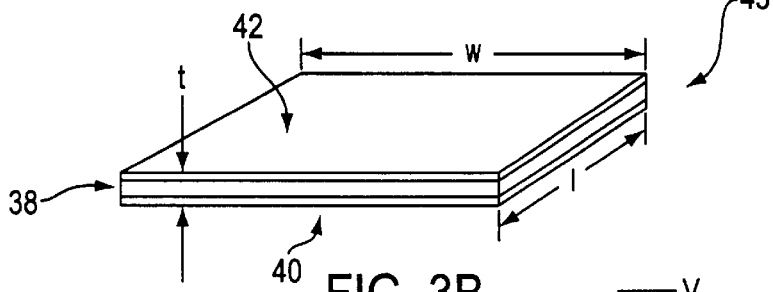
FIGS. 3*a* and 3*b* shows the response of the elastomeric polymer film to an applied voltage.

FIG. 3*a* shows the basic functional element of the present invention. A thin elastomeric polymer film or layer 38 is sandwiched between compliant electrode plates or layers 40 and 42. This combination of layers 38, 40, and 42 will be referred to herein as an "multi-layer membrane" 43. In this elastomeric polymer film actuator, the elastic modulus of the electrodes is generally less than that of the film, and the length "l" and width "w" of the film are much greater than the thickness "t".

Figure 3B:
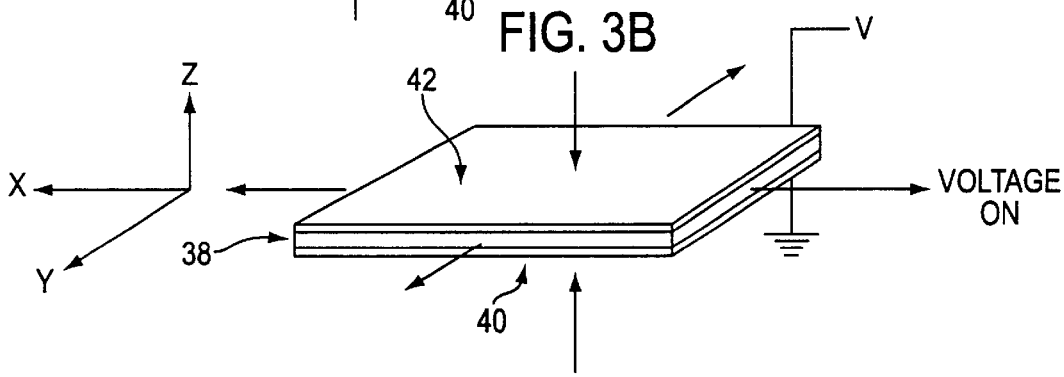

As seen in FIG. 3*b,* when a voltage is applied across the electrodes, the unlike charges in the two electrodes are attracted to each other and these electrostatic attractive forces compress the film in thickness. The repulsive forces between like charges in each electrode tend to stretch the film in the plane. The effective pressure corresponding to this electrostatic model of actuation is $$p=ee_oE^2=ee_oV^2/t^2 \quad \text{(Equation 1)}$$

where p is the effective pressure, e is the relative dielectric constant of the polymer film, $e_o$ is the dielectric constant of free space, E is the electric field (equal to the applied voltage divided by the film thickness). This effective pressure includes the effect of both the electrostatic attractive and repulsive forces.

The resulting strain of the film will depend upon its elastic behavior and external pressure loading. For the largest strains produced (over 25%) assumptions of linear strain response and constant modulus of elasticity are not strictly valid. However, such assumptions simplify greatly the equations of motion and are presented here to illustrate the operation of the invention. The external pressure loading on the film due to inertia of the air and the diaphragm itself are small (at lower frequencies) compared to the internal stresses from the elastic deformation of the film and will also be ignored for purposes of illustrating the operation of the invention. Based on these assumptions, we model the polymer elastomers as linearly elastic materials. The strain in thickness is then $$s=-p/Y=-ee_oE^2/Y \quad \text{(Equation 2)}$$

where Y is the modulus of elasticity of the polymer film.

Most elastomeric polymers behave as essentially incompressible materials with a Poisson ratio of nearly 0.5. Thus, there will be stresses and strains produced in the plane of the film equal to nearly one half of those described by Equations 1 and 2. These stresses and strains will be tensile, tending to increase the area of the film.

The magnitude of the strains developed in the film are limited by the dielectric strength and elastic properties of the material. A commercially available silicone rubber (Dow Corning HSIII,centrifused to eliminate particulate additives, principally a polydimethylsiloxane) compound has produced the largest strains of all elastomers surveyed. This material has developed over 30% strain in the two orthogonal in-plane directions. Such a strain corresponds to over a 69% increase in the film area.

The goals for the acoustic actuator are to be able to displace a large volume of air in a low profile and lightweight package. These goals are achieved by using the area change developed in the film to produce out-of-plane displacement with a minimum of additional structure.

If an area of film is held at its edges, then the in-plane strains will produce a buckling effect. Since the film is thin compared to its lateral dimensions, we can ignore bending stresses and the magnitude of the strains will be nearly that given by Equation 2 above for an unconstrained film.

Figure 4A:
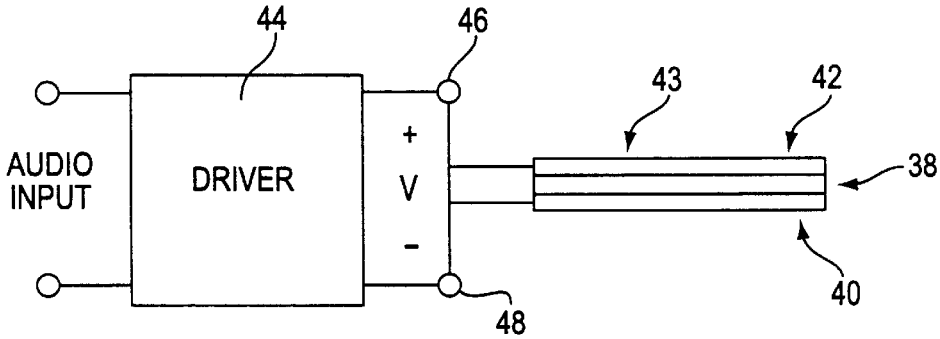
FIGS. 4*a* and 4*b* illustrate the structure and operation of the actuator that allows the response of the elastomeric polymer film to be converted to out-of-plane deflections.
Figure 4B:
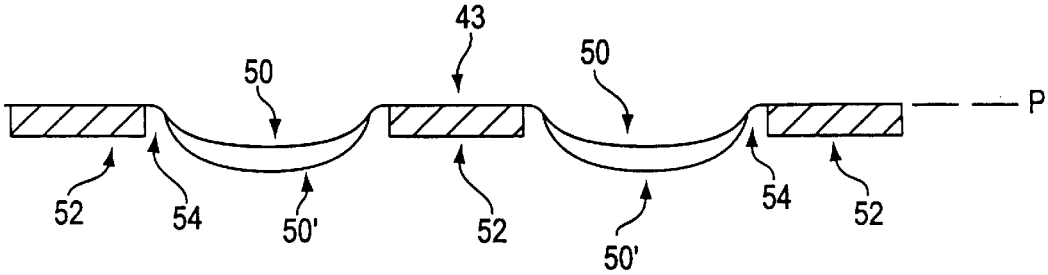

FIGS. 4*a* and 4*b* are used to illustrate the above-described principle. A constant bias pressure on one side of the film controls the buckling direction and film profile (see FIG. 4*b*) without diminishing the magnitude of the strains developed by the electric field. It is possible to control the direction of buckling in other ways as well. For example, the diaphragm may be pre-stressed so that there is greater tensile stress toward the upper surface. The diaphragm would then tend to buckle away from this upper surface to relieve this additional stress. The pre-stress can be created by deflecting the diaphragm away from the upper surface before it has completely cured. A similar effect can be achieved by creating a diaphragm that is stiffer toward the bottom surface, or that has a stiffer electrode on the bottom surface.

The device is kept low-profile without significantly compromising its displacement capabilities by using a number of smaller curved film areas ("bubbles") with correspondingly smaller out-of-plane displacements rather than a single large area that would move a great distance out of plane. The use of smaller film areas also prevents the generation of higher-order displacement modes at the higher frequencies. In fact, the upper limit for bubble area in some applications would be determined by the minimum frequency at which these higher-order modes (which reduce the radiation efficiency of the actuator) appear. Bubbles of different areas, each driven over a different range of frequencies, may be combined on a single actuator in order to maximize the power output for a given actuator area, while maintaining high fidelity. Such spectral separation of the audio signal is well known.

More particularly, in FIG. 4*a,* a driver 44 has an audio input and has a pair of outputs 46 and 48 that are coupled to electrodes 42 and 40, respectively. As seen in FIG. 4*b,* a bias pressure applied to the membrane 43 causes an out-of-plane protrusion of the membrane 43. That is, a protrusion, bulge, or "bubble" 50 is formed by a biasing force on the membrane 43 which is substantially perpendicular to the plane P of the membrane 43. The signal from the driver 44 can cause further movement or modulation of the bubble 50 to, for example, a position 50'. The membrane 43 is supported by a support structure 52 provided with a plurality of apertures 54.

A preferred embodiment of the device is shown in an exploded perspective view in FIG. 5*a,* and in an assembled, perspective view in FIG. 5*b.* A single film 56 of silicone rubber of uniform thickness is placed over a matrix or grid 58 of circular holes. Alternatively, the holes may be other shapes such as slots or squares. The size and shape of the holes is determined by the application, but they typically range in size from 1–5 millimeters. Graphite powder is rubbed on each side of the film to serve as the compliant electrodes. Typically, a polymer binder, such as gelatin mixed with glycerol, is added to the graphite to improve conductivity or mechanical adhesion. Copper connectors 60 (one on the top of the film and one on the bottom of the film) are offset and there is no graphite on the film directly opposite the connectors, in order to minimize the chance of dielectric breakdown due to charge concentrations at the edge of the connectors. Other elastomeric dielectric polymers, for example, fluorosilicone, polyurethane fluoroelastomer, natural rubber, polybutadiene, nitrile rubber, isoprene, polyurethane, and ethylene propylene diene may be used in place of silicone.

The hole grid is made of a lightweight material, such as a plastic that is much stiffer than the silicone rubber. Alternatively, it may be an elastomer itself, provided it is sufficiently stiff to support the polymer film actuator with negligible deflection during actuation.

The vacuum plenum allows for the imposition of a bias pressure while simultaneously acting as a resonance cavity. Elastomeric gaskets 62 and 64 seal the film and grid 58 to the face plate 66 and plenum plate 68, respectively. When assembled, the plenum 70 defined by the plenum plate 68and the membrane 56 may be evacuated by a vacuum or negative pressure source to provide the bias pressure. Only a slight reduction in the internal pressure of plenum is generally needed relative to the surrounding atmosphere.

Alternatively, if the polymer film actuator initially has a bubble-like shape (inward into the plenum), a one-way valve can be connected to the plenum 70 and the surrounding atmosphere so as to allow air to flow out of the plenum into the atmosphere, but not the reverse direction. In this embodiment, when the polymer film is initially actuated, it will push air out of the plenum into the atmosphere through the one-way valve so that the actuator is self-pumping and a separate vacuum source is not needed.

The device of FIGS. 5*b* has the film curved towards the plenum 70 due to its reduced gaseous pressure. However, the device can also be made with all the bubbles curved outward from the plenum, as seen in FIG. 6. In this case, the desired bias pressure is positive rather than negative relative to the surrounding atmosphere, and can be supplied, for example, using a positive pressure source rather than a vacuum source. More particularly, the membrane 72 is attached to a support structure 74 having a plurality of apertures 76. The support structure 74 is attached to a plenum plate 78 to form the plenum 80 behind the bubbles 82.

While thinner films would allow for lower operating voltages, their fragility becomes an issue for a practical actuator. However, by using a film stack of multiple layers separated by electrodes, the low voltage operation of a thin film and the ruggedness and greater energy output of a thicker film can be combined. FIG. 6A is a magnified view of a section 85 (FIG. 6) illustrating this "sandwich" structure of alternating conductive lauers 84 and dielectric layers 86.

As shown in FIG. 7*a,* an alternative to a plenum pressurized with air is to apply a bias pressure to the polymer film using a soft foam 88. The foam would ideally be closed-cell with the cell size much less than the diameter of the film bubble 90. The foam is pressed against the undersurface 92 of the polymer film 94. A backing plate or sheet 96 is located under the foam. Bolts, rivets 98, stitching or adhesives would attach the backing plate 96 to the grid and thereby squeeze the foam against the polymer film. The holes 100 through the polymer film of sheet 96 for these rivets 98 can be seen in FIG. 7*b*. The holes are provided to prevent the rivets from creating electrical shorts in the membrane 94.

The rivets are located at a spacing sufficient to provide a uniform pressure on the foam and are located between active bubbles. The amount of bias pressure applied by the foam is selected to give the desired initial bubble shape and can be selected based on the stiffness of the foam and the amount of foam compression. An extremely soft, low-creep foam, such as made from silicone or natural rubber, is preferred because it is desirable that the bubble shape not change significantly over time.

Figure 8:
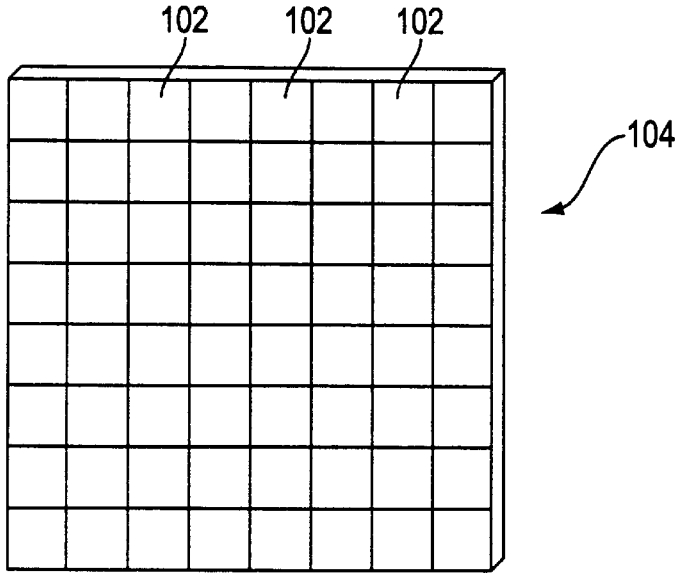
FIG. 8 illustrates the assembly of a number of acoustic actuator tiles into an extended acoustic actuator sheet.

The acoustic actuator of the present invention is preferably manufactured as a single block, tile or panel. As seen in FIG. 8, many of such tiles 102 can be combined into a sheet 104 and applied to a surface to form a conformal covering. The size of the tiles is determined by manufacturing considerations, and may be quite small (e.g. 1 $cm^2$) or relatively large (e.g. 100 $cm^2$). A tile therefore includes a number of acoustic elements (e.g. "bubbles") in a related physical structure. Individual tiles may be electrically coupled to adjacent tiles, or may be electrically isolated from adjacent tiles.

If the plenum is relatively flexible, such as sheet metal or sheet plastic, and the grid is correspondingly made of a flexible material, then a single larger tile 102 can be used to conformally cover simple curved surfaces such as a cylinder. Further, if both the grid and plenum can be stretched (e.g. they are elastomeric materials), then conformal coverings of relatively large areas can be made on even complex curved surfaces such as spheres.

An embodiment of the present invention is composed of essentially two-dimensional layers and is thus well suited for fabrication techniques commonly used in electronics such as spin-coating and photolithography. For example, a layer of silicone rubber elastomer is spun onto a plastic or glass disk or a sacrificial layer. The upper surface of the elastomer is coated with a compliant electrode material such as a conductive polymer. Conductive polymers include materials such as polyurethane and other thermoplastics that have been made conductive through the addition of quaternary ammonium salts as well as polymers formed from water-based emulsions to which inorganic salts, such as potassium iodide, have been added. If desired, several layers of elastomer can be deposited. Electrodes are deposited on top of each elastomer layer in an interdigitated manner (so that consecutive electrode layers extend to opposite edges and overlap only in the central region of the film.) A layer of polyimide photoresist is spun on top of the final layer of electrode material. Round or square holes are patterned in the photoresist using photolithography. The patterned polyimide layer comprises the rigid hole matrix. The elastomer is released from the disk using alcohol. The newly freed elastomer surface is coated with compliant electrode material. Electrical contact is made to the electrodes outside of the overlapping region.

An actuator fabricated in this manner can be extremely flat. The very small diaphragm areas that can be fabricated in this manner also increase the minimum frequency at which higher-order mode shapes will appear in the bubbles. If transparent polymers or other materials are used as the electrodes and dielectric, the actuator can be essentially transparent. Many of the conductive polymers are nearly transparent.

Electronic drivers are connected to the electrodes. As with other electrostrictive devices, the actuator would typically be driven electrically by modulating the applied voltage about a DC bias voltage. Modulation about a bias voltage allows for improved sensitivity and linearity of the actuator to the applied voltage. Since the displacement of the film will be roughly proportional to the square of the applied voltage, the linearity of the response to a desired input waveform can be further improved by adding digital or analog circuitry that produces the square root of the input or some other linearizing function. A circuit for implementing the square root functionality will be discussed below with reference to FIG. 10. Other methods of linearization are also known to those skilled in the art. The input signal to the actuator driving circuit depends upon the application. For consumer audio it may be from a recorded medium or microphone. For active noise and vibration control applications the signal will be synthesized based on microphones (or accelerometers) located at various points on or near the actuator.

The driving circuits may include power amplification and voltage conversion means which are well known. If desired for control of spatial resolution, separate drivers may be attached to individual actuator tiles, groups of tiles or portions of the actuator.

A critical fabrication issue is production of thin dielectric films of uniform thickness. In order to minimize the applied voltage, thin films, typically less than 100 micrometers thick, are needed.

The thin films may be fabricated by several methods. For example, commercial silicone rubber, which often comes in a paste-like consistency, can be dispersed in naphtha to reduce the viscosity to a pourable liquid. The liquid can then be formed into a film either by flatcasting, dipping or spinning.

The compliant electrodes may be deposited on the film by several methods. Graphite or other forms of carbon may be brushed on, sprayed on or vapor deposited. The electrodes may be patterned with stencils or shadow masks. Conductive polymers such as water-based rubber emulsions with salts, or solvent based thermoplastics with salts may be brushed, sprayed or spun on to the polymer dielectric. The thickness of these electrodes should be much less than the thickness of the elastomeric polymer film.

In a preferred embodiment of the invention, the actuator is a single tile from 10 to 100 square-centimeters in area. The tile comprises a flexible backing made from a thin polyimide sheet. A layer of soft closed-cell rubber foam approximately 0.5 cm thick is glued to the backing. A layer of electroded elastomeric polymer material is placed on top of this foam. The elastomeric polymer is a soft silicone rubber such as Dow Coring HSIII. This polymer film is 20–50 microns thick and is produced by spin coating on an acrylic disk. The film is released from the disk with isopropyl alcohol. The electrodes are graphite powder that has been rubbed onto the polymer with soft cotton. A stencil defines the area of graphite coverage. Small circles of unelectroded areas are spaced evenly over the surface of the film. A thin layer of a water-based latex rubber with approximately 10% by weight potassium iodide salt added to the latex is spread over the graphite and allowed to dry. Copper strips connect to electrodes on each side of the polymer. A perforated sheet of plastic is placed over the elastomeric polymer. This perforated sheet has holes of approximately 1 mm diameter evenly spaced and closely packed over its surface. The holes are made by a die cutter or laser cutting machine. The holes are approximately 1 mm in diameter and are evenly spaced and closely packed over the surface of the tile. Small rivets, or similar fasteners, are placed through this assembly coinciding with the unelectroded areas of the film and space between bubbles. These fasteners cause the foam to compress and force the elastomeric polymer film to bulge slightly out of the perforated holes forming the "bubbles" that act as the sound producers. Many such tiles are fastened to a common flexible backing sheet that measuring from 1 to 5 square-meters. The electrodes of each tile are connected in parallel.

These electrodes are preferably driven by a signal of up to 200 to 1000 V peak to peak with a bias voltage of 750 to 2000 V DC. The exact voltages will depend upon the specifics of the application. The signal may be a signal from a stereo player or microphone that has been amplified and converted to the correct voltage range. However, it will be appreciated that the actual drive voltage is based upon the parameters of the application. Higher voltages provide a higher amplitude but with more distortion. The actual drive voltage is therefore a compromise between desired output power and acceptable distortion levels.

Figure 9:
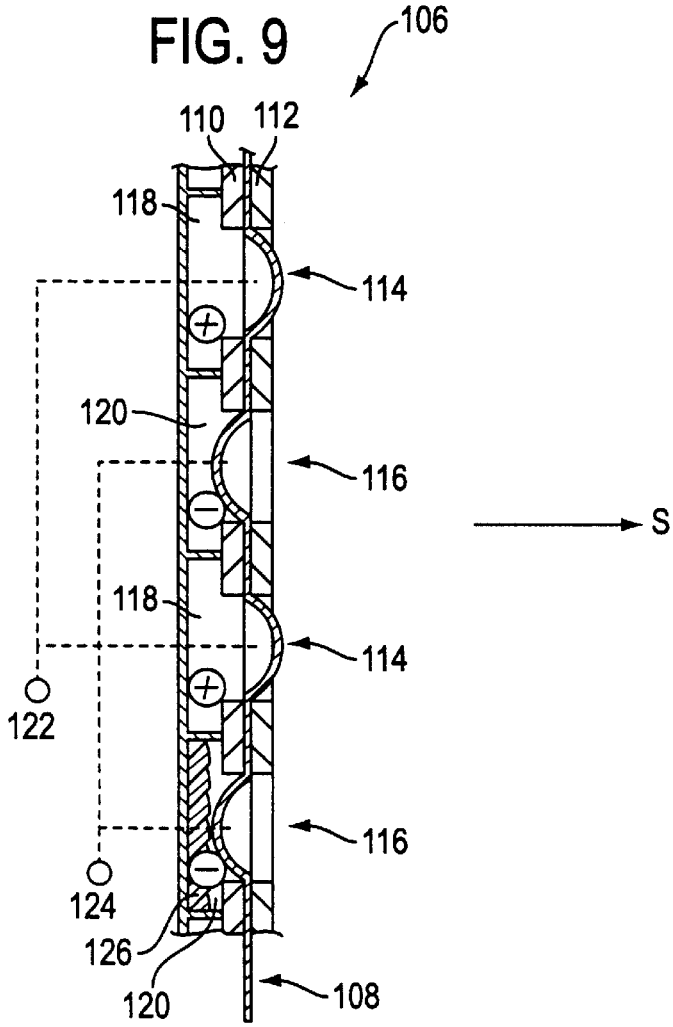
FIG. 9 is a cross-sectional view of a "push-pull" embodiment of the present invention.

In FIG. 9, an interdigitated array or sonic actuator 106 of vertical columns of "push" and "pull" bubbles is shown. This arrangement reduces the second harmonic distorion present with sonic actuators where all of the bubbles are arranged in the same direction, as described previously. The "push" and "pull" bubbles tend to cancel out second harmonic distortion in a fashion analogous to how a push-pull transistor amplifier tends to cancel out second harmonic distortions in electronic circuits. While the following example illustrates every other bubble being in opposite directions, it should be noted that this is not a strict requirement to attain the desired cancellation. That is, in some embodiments of the present inventions, more of the bubbles will be protruding in one direction or the other, or clusters of bubbles will be extending in one direction or the other.

More particularly, the structure 106 of FIG. 9 includes a rubber membrane 108, a rear support plate 110, and a front support plate 112, where portions of the rubber membrane 108 form "push" bubbles 114, and where other portions of the rubber membrane form "pull" bubbles 116. The sound output S travels to the right, as shown.

The structure 106 also includes interdigitated plenums 118 and 120 attached to the rear support plate 110. The plenums 118 associated with the push bubbles 114 are pressurized with a positive pressure, and the plenums 120 associated with the pull bubbles 116 are pressurized with a mild vacuum (e.g. less than 1 psig). All of the push bubbles 114 are electrically coupled together as indicated at 122, and are driven with an audio signal plus bias. The pull electrodes are also electrically coupled together as indicated at 124, and are driven by the bias minus the audio signal.

As with a conventional loudspeaker, there should be some provision for dissipating the sound produced by the back (plenum) side of each bubble. One method would involve filling the plenums with an acoustic absorber such as fiberglass 126. The push-pull (or "up-down" depending on the orientation) sonic activator of FIG. 9 is capable of producing a high level of fidelity.

Figure 10:
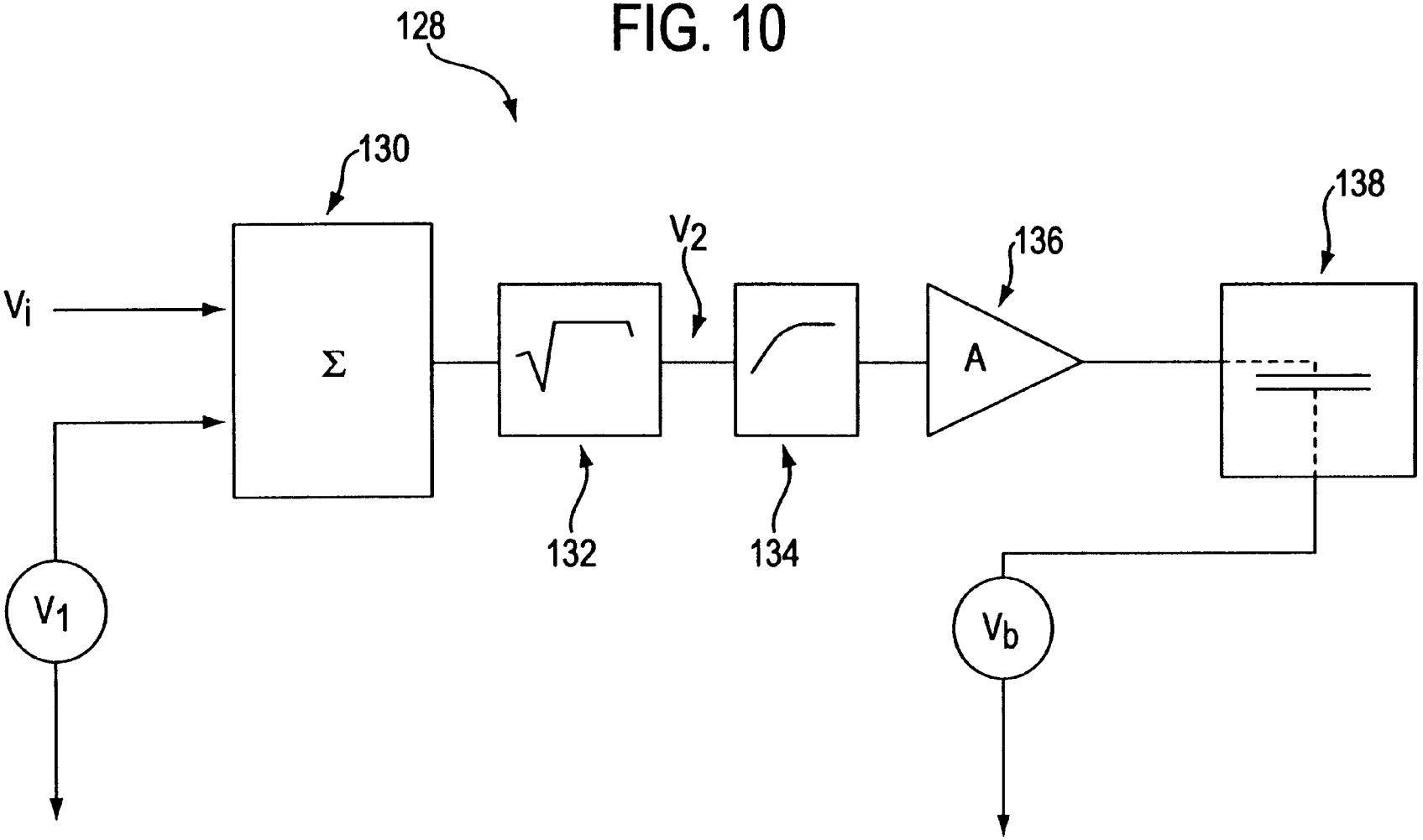
FIG. 10 is a block diagram of a square root driver circuit of the present invention.

A "square root" circuit is illustrated in FIG. 10. As noted previously, since the displacement of the film will be roughly proportional to the square of the applied voltage, the linearity of the response to a desired input waveform can be improved by adding digital or analog circuitry that produces the square root of the input. In this circuit 128, the low power input signal Vi is added to an offset voltage, $V_1$. in a summer 130 The square root operation is then performed on the sum in a square root generator 132. Next, the resulting signal is passed through a high-pass filter 134. For a typical audio application the filter corner frequency would be between about 10 Hz and 1 KHz, chosen to lie below the frequencies to be produced by the speaker. Next, the filtered signal is amplified by a power amplifier 136 having a gain A. The output of this amplifier drives a speaker 138. The bias voltage $V_b$ is applied to the other speaker terminal.

The values of $V_1$ and $V_b$ are chosen to minimize distortion. In a typical application, $V_1$ is chosen such that:

$$V_b = AC_1 \mathrm{sqrt}(V_1) \qquad \text{(Equation 3)}$$

where A is the gain of amplifier 136 and $C_1$ is a correction factor (typically between 0.95 and 1.0) that accounts for the DC components present in the output signal of the square root circuit.

It will therefore be appreciated that the sonic actuator of the present invention includes a multi-layer membrane having an elastomeric dielectric polymer layer with a first surface and a second surface; a first compliant electrode layer contacting the first surface; and a second compliant electrode layer contacting the second surface. The sonic actuator further includes a support structure in contact with the sonic actuator film. Preferably, the dielectric polymer is selected from the group consisting essentially of silicone, polyurethane fluorosilicone, fluoroelastomer, natural rubber, polybutadiene, nitrile rubber, isoprene, ethylene propylene diene, or other soft high resistivity elastomer, while the compliant electrode layer is selected from the group consisting essentially of graphite, carbon, and conductive polymers. The support structure is a preferably a grid having a plurality of round or square apertures. Preferably, the multi-layer membrane is biased such that portions of the film bulge at at least some of the apertures. The bulges or "bubbles" are out of the plane of the actuator, and may all be in one direction, or may be provided in a plurality of directions. By "out-of-plane" it is meant that the bubble extends out of a local plane defined by material surrounding the bubble. The film may be biased by a gaseous pressure that is greater than atmospheric pressure, or less than atmospheric pressure (i.e. a partial vacuum). Alternatively, the film can be biased by a soft foam material. The foam material is preferably a closed-cell foam with an average cell diameter substantially less than the diameter of the apertures. In one embodiment of the present invention, the bubbles may alternate to provide a push-pull arrangement. In another embodiment of the present invention the multi-layer membrane is a sandwich structure having a number of layers of elastomeric dielectric polymers alternating with a number of layers of compliant electrodes.

Although the invention is described herein with reference to several preferred embodiments, one skilled in the art will readily appreciate that permutations, substitution, additions and equivalents may be substituted for the embodiments set forth herein without departing from the spirit and scope of the present invention. It is therefore intended that the following appended claims be interpreted as including all such permutations, substitutions, additions, and equivalents as fall within the true spirit and scope of the present inventions.

What is claimed is:

1. A sonic actuator film comprising:

a multi-layer membrane including
- an elastomeric dielectric polymer layer having a first surface and a second surface;
- a first compliant electrode layer contacting said first surface; and
- a second compliant electrode layer contacting said second surface;

a square root driver coupled to said first compliant electrode and to said second compliant electrode, wherein said square root driver includes a summer adding a low power input signal to an offset voltage and a square root generator coupled to an output of said summer;

a filter coupled to an output of said square root generator, and a support structure in contact with said sonic actuator film.

2. A sonic actuator as recited in claim 1 further comprising an amplifier coupled to an output of said filter to provide a signal to drive said multi-layer membrane.

* * * * *